US006644485B2

(12) United States Patent
Uchida et al.

(10) Patent No.: US 6,644,485 B2
(45) Date of Patent: Nov. 11, 2003

(54) METHOD OF AND APPARATUS FOR CONTROLLING STACKING OF A LOAD BY A CRANE

(75) Inventors: Kouji Uchida, Hiroshima (JP); Noriaki Miyata, Hiroshima (JP); Kanji Obata, Hiroshima (JP); Tadaaki Monzen, Hiroshima (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/067,313

(22) Filed: Feb. 7, 2002

(65) Prior Publication Data

US 2002/0108919 A1 Aug. 15, 2002

(30) Foreign Application Priority Data

Feb. 13, 2001 (JP) ..... 2001-036015

(51) Int. Cl.[7] ..... B66C 13/18

(52) U.S. Cl. ..... 212/270; 212/273; 212/275

(58) Field of Search ..... 212/272–275, 212/270; 414/140.3, 140.4, 141.3, 141.4, 803

(56) References Cited

U.S. PATENT DOCUMENTS 5,909,817 A * 6/1999 Wallace et al. ..... 212/275
6,256,553 B1 * 7/2001 Erikkila ..... 700/213

FOREIGN PATENT DOCUMENTS

WO 91/14644 * 10/1991 ..... 212/286

* cited by examiner

*Primary Examiner*—Thomas J. Brahan
(74) *Attorney, Agent, or Firm*—Armstrong, Westerman & Hattorri, LLP

(57) ABSTRACT

An apparatus for controlling stacking of a load by a crane estimates a periodical displacement of a horizontal position of a tool. A speed with which the tool descends is controlled such that the tool or a load held by the tool lands on a desired position when the amplitude of the periodical displacement becomes maximum.

10 Claims, 7 Drawing Sheets

METHOD OF AND APPARATUS FOR CONTROLLING STACKING OF A LOAD BY A CRANE

BACKGROUND OF THE INVENTION

1. Field of the Invention

The present invention relates to a method of and an apparatus for controlling stacking of a load by a crane. More particularly, the present invention relates to the method of and the apparatus for controlling stacking of a load by a crane which is positioned a tool of the crane at a target position, is allowed to land, or in which load held by the tool is positioned at the target position and stacked.

2. Description of the Related Art

A typical example of the above-mentioned apparatus is a crane (i.e. a container transfer crane. Hereafter "transfer crane") which stacks containers one above the other. This transfer crane positions a tool or a load (i.e. the container) held by the tool at a desired target position, and then makes the tool or the load to land and thus stacks the tool or the load. The crane has a trolley (transverse trolley) which moves in the horizontal direction along a camber of a crane bodywork. The tool which supports the load is hung down from the transverse trolley using a rope. The tool ascends and descends when the rope is reeled or unreeled. The rope is reeled or unreeled using a reeling apparatus mounted on an appropriate position in the trolley or the crane itself.

When the tool or the load is to positioned on the target position and the tool or the load is landed or stacked, it is necessary to control such that horizontal deviation is not caused between the target position and the tool or the load at the time of stacking or landing. As a technique which controls this kind of landing, there is one shown in Japanese Patent Application Laid-open No. 10-120362.

In the landing control apparatus shown in Japanese Patent Application Laid-open No. 10-120362, amount of swing of the load in the horizontal direction is measured by a detector. Then, future horizontal position of the load is estimated and calculated based on assumption that horizontal motion of the load is in the form of a sine wave of a simple pendulum. The future horizontal position of the load is estimated using swinging speed of the load calculated by time variation in singing amount. If the calculated future position of the tool coincides with the target position, then descending speed of the tool is controlled in accordance with estimating timing, and control is carried out such that the load precisely reach the target position.

The landing control apparatus described in Japanese Patent Application Laid-open No. 10-120362 uses a simple pendulum having a fixed hanging point, as a model which estimates a future horizontal position of the load. In landing control described in Japanese Patent Application Laid-open No. 10-120362, the trolley is on a constant position while landing is controlled, and the control is unconcerned for position control of the load in the horizontal direction.

There is no problem with the technology described in Japanese Patent Application Laid-open No. 10-120362 using a simple pendulum model when the body of the crane is sufficiently rigid and it is judged that a rope hanging point on the trolley is substantially fixed. However, when the rigidity of the crane bodywork is low and a rope supporting point on the trolley can not be regarded as a fixing point and if the simple pendulum model is used to approximate a motion of the system of load and rope, then a large error is generated in a value of an estimated future load position. This causes an inadmissible deviation in real and future positions of the load. If the crane is a gantry crane having tall legs or a tire-running type crane, then the variation in the position of the trolley ("trolley position") generated by deformation of leg structure or tire is large, and it can not be ignored.

In some of ropes which support the load, an auxiliary rope disposed is in an inclining manner is added to give a force in the horizontal direction to the load, thereby obtaining swing preventing effect. If a simple pendulum model is used, a large error may be generated in estimation of position of the load.

Furthermore, in the technology described in Japanese Patent Application Laid-open No. 10-120362, descending timing of the load is controlled such that the horizontal direction position of the load coincides with time point when permissible range is obtained with respect to a target position while a trolley position, i.e., a rope fulcrum position which supports the load is fixed. However, when a large deviation in horizontal direction exists between the trolley position and a position on the ground where the load is to be stacked, it is necessary to correct the position of the trolley also. However, even if the trolley position is corrected, new horizontal motion of the tool is generated, which affects estimation of future position of the tool and as a result, time required for controlling the landing control is increased in some cases.

SUMMARY OF THE INVENTION

It is an object of the present invention to provide a method of and an apparatus for controlling stacking of a load by a crane capable of allowing a load to land with high precision and capable of shortening time required for the landing operation even if the trolley position of the rope is varied due to deformation or swing, and even if a rope system can not be regarded as being simple pendulum. Moreover, this invention provides a method of and an apparatus for controlling stacking of a load by a crane capable of enhancing loading efficiency by reducing labor of a crane operator.

The method of controlling stacking of a load by a crane according to one aspect of the present invention is applied to a crane having a trolley which moves in a horizontal direction, a tool which is hung down using a rope from said trolley and which holds said load, and a rope reeling unit which reels or unreels said rope and thereby ascends or descends said load and stacks said load or said tool to a desired position. This method comprises estimating periodical displacement of said tool in a horizontal position, estimating a speed with which said tool descends in such a manner that said tool or said load lands on the desired position while an amplitude of the estimated periodical displacement becomes maximum, and controlling reeling or unreeling of said rope by said rope reeling unit in such a manner that said tool or said load descends at the estimated speed.

The method of controlling stacking of a load by a crane according to another aspect of the present invention is applied to a crane having a trolley which moves in a horizontal direction, a tool which is hung down using a rope from said trolley and which holds said load, and a rope reeling unit which reels or unreels said rope and thereby ascends or descends said load and stacks said load or said tool to a desired position. This method comprises estimating periodical displacement of said tool in a horizontal position, positioning and stopping said trolley at a trolley stop position which is deviated from a stacking target position by a distance corresponding to a maximum amplitude of the periodical displacement, and estimating a speed with which said tool descends in such a manner that said tool or said load lands on the desired position while an amplitude of the estimated periodical displacement becomes maximum, controlling reeling or unreeling of said rope by said rope reeling unit in such a manner that said tool or said load descends at the estimated speed.

The apparatus for controlling stacking of a load by a crane according to still another aspect of the present invention controls a crane having a trolley which moves in a horizontal direction, a tool which is hung down using a rope from said trolley and which holds said load, and a rope reeling unit which reels or unreels said rope and thereby ascends or descends said load and stacks said load or said tool to a desired position. This apparatus comprises an estimating/calculating unit which estimates or calculates periodical displacement of said tool in a horizontal position, a speed estimating unit which estimates a speed with which said tool descends in such a manner that said tool or said load lands on the desired position while an amplitude of the estimated periodical displacement becomes maximum, and a rope reeling control unit which controls reeling or unreeling of said rope by said rope reeling unit in such a manner that said tool or said load descends at the speed estimated by said speed estimating unit.

The apparatus for controlling stacking of a load by a crane according to still another aspect of the present invention controls a crane having a trolley which moves in a horizontal direction, a tool which is hung down using a rope from said trolley and which holds said load, and a rope reeling unit which reels or unreels said rope and thereby ascends or descends said load and stacks said load or said tool to a desired position. This apparatus comprises an estimating/calculating unit which estimates or calculates periodical displacement of said tool in a horizontal position, a trolley stopping unit which positions and stops said trolley at a trolley stop position which is deviated from a stacking target position by a distance corresponding to a maximum amplitude of the periodical displacement, a speed estimating unit which estimates a speed with which said tool descends in such a manner that said tool or said load lands on the desired position while an amplitude of the estimated periodical displacement becomes maximum, and a rope reeling control unit which controls reeling or unreeling of said rope by said rope reeling unit in such a manner that said tool or said load descends at the speed estimated by said speed estimating unit.

Other objects and features of this invention will become apparent from the following description with reference to the accompanying drawings.

DETAILED DESCRIPTIONS OF THE PREFERRED EMBODIMENTS

Figure 1:
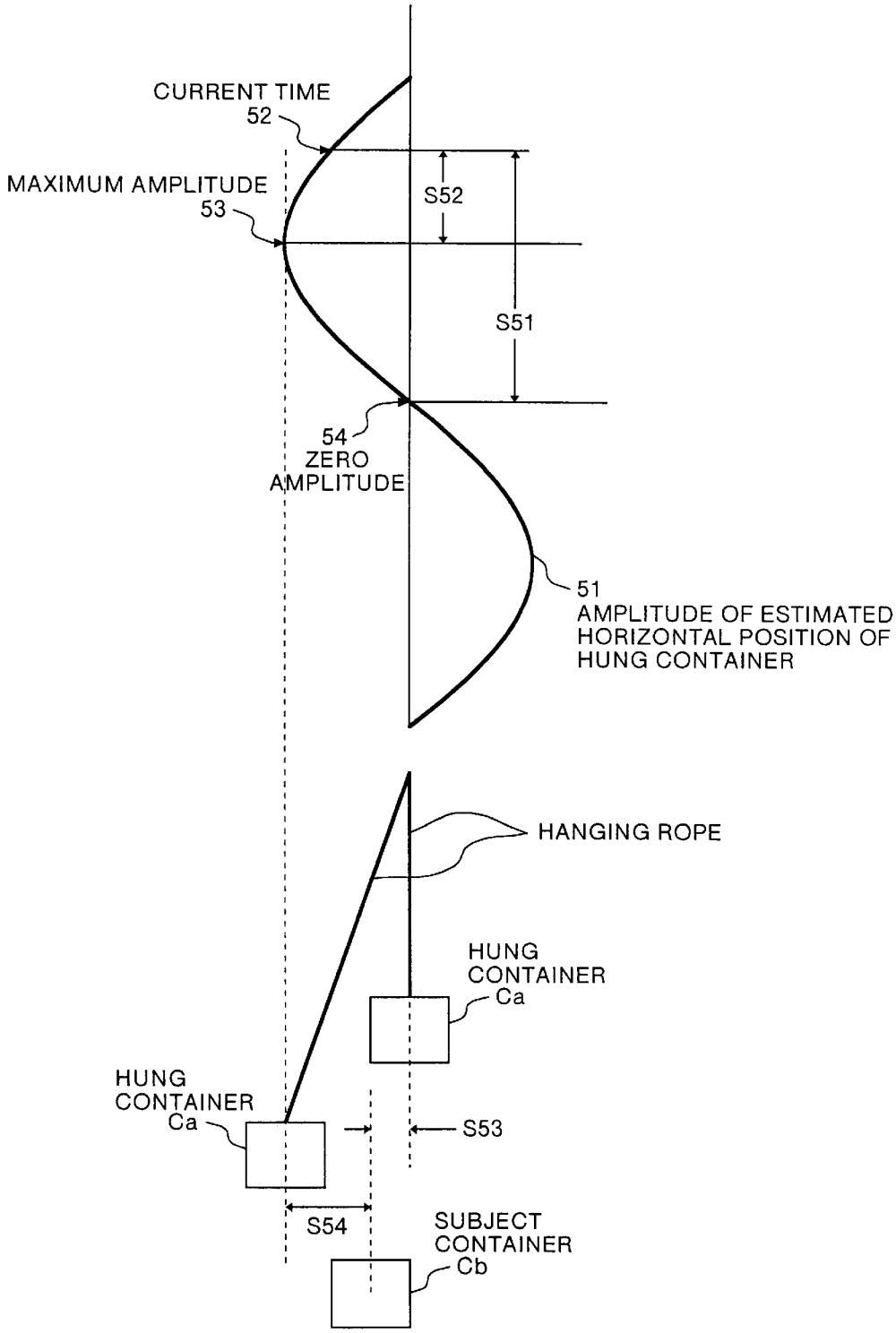
FIG. 1 is an explanatory view of detection of coincidence of horizontal position at the time of landing concerning a stacking control apparatus of the invention.

A method of and an apparatus for controlling stacking of a load by a crane according to the present invention will be explained with reference to the accompanying drawings in the order of Outline of the Invention and Embodiment.

Outline of the Invention

A method of and an apparatus for controlling stacking of a load by a crane of the present invention comprises a trolley which moves in a horizontal direction, and a tool which is hung down from the trolley and which ascends and descends by reeling or unreeling a rope by a reeling apparatus. When the tool or load is landed, periodical displacement of the horizontal position of the tool is estimated. The speed of descending of the tool is controlled such that when amplitude of the periodical displacement becomes maximum, the tool or the load held by the tool is landed on a stacking target position.

Before describing an embodiment of the present invention, an outline of the present invention will be explained based on a case in which a container (i.e. the load) held by a tool is stacked on a predetermined target position in yard using a transfer crane.

The transfer crane comprises a trolley which moves in the horizontal direction, and the tool which is hung down from the trolley by the rope and which ascends and descends by reeling or unreeling of the rope. The rope is reeled or unreeled using the reeling apparatus mounted on the trolley.

The following explanation can also be applied to an operation which lands the tool on a container stacked on a predetermined container, or an operation which stacks the hung container on a predetermined position in a container stacking place. Description concerning the tool in the following explanation is applied irrespective of whether or not the tool grasps the container or the load unless otherwise specified. Similarly, description concerning the hung container or load is also applied to a case in which the tool does not grasp the hung container or load unless otherwise specified.

In the stacking control method of crane of the present invention, the current horizontal position displacement (lateral swing) of the hung container, horizontal position displacement speed (lateral swing speed), trolley position, its moving speed, hung container height, its speed of descending and the like are measured from moment to moment. With respect to the measurement values, dynamic behavior of elements related to horizontal position displacement of hung container such as a structure (including running tire) of the crane, behavior of trolley driving machine apparatus, behavior of the rope (including swing-preventing auxiliary rope) are modeled as a simulation model, and future horizontal position of the hung container is estimated and calculated by the simulation model.

By estimation and calculation carried by the measurement values such as horizontal direction position displacement of the hung container and horizontal direction position displacement speed, time required from the current time until the horizontal direction position displacement of the hung container reaches preset amplitude is calculated. A deviation in horizontal position between the hung container and the subject container in the stacking target amplitude is estimated and calculated, and if it is equal to or greater than permissible value, the trolley position is moved such that the horizontal position variation is reduced. A moving direction of the trolley, a moving speed, acceleration and the like are calculated by a model of dynamic behavior such as structure (including running tire) of the crane, behavior of trolley driving machine apparatus, behavior of the rope (including swing-preventing auxiliary rope).

The apparatus has an estimating/calculating unit which measures a deviation in position of the hung container in a height direction of the subject container and hung container speed of descending, and which estimates time required for the hung container to land on the subject container based on the measurement values. The speed of descending of the hung container and timing which vary the speed of descending are controlled such that time required to land on the stacking target amplitude from the current time and estimated time required for the hung container to land on the subject container coincide with each other.

A result of estimation and calculation of the horizontal position of the hung container is periodic horizontal motion, but a problem whether the hung container is allowed to land on the subject container in what kind of amplitude state of the periodical horizontal position displacement is related to relative position deviation precision between the hung container and the subject container at the time of landing. Usually, the landing is controlled such that horizontal positions of the hung container and the subject container coincide with each other when the amplitude is 0 or the amplitude is maximum.

FIG. 1 is a diagram which explains a case in which coincidence of horizontal position is detected with amplitude 0 and maximum amplitude when the hung container is allowed to land on the subject container while bringing the horizontal positions of both the containers into coincidence with each other. A curve 51 shows vibrational variation in amplitude of amplitude of horizontal motion of the hung container. A reference number 52 shows the current time, a reference number 53 corresponds to time when the amplitude of the horizontal motion becomes maximum, and a reference number 54 corresponds to time when the amplitude becomes minimum. A reference symbol S51 shows time from the current time to the instant when the amplitude becomes minimum, and a reference symbol S52 shows time from the current time to the instant when the amplitude becomes maximum.

A reference symbol S53 shows a deviation between the subject container position and the hung container position when the horizontal motion amplitude of the hung container is 0, and a reference symbol S54 shows a deviation between the subject container position and the hung container position corresponding to a case in which the amplitude is maximum. That is, FIG. 1 shows that when amplitude which detects coincidence of horizontal position is set to 0, it is necessary to adjust a rope support point position corresponding to S53, and when the amplitude is set to maximum, it is necessary to adjust the rope support point position corresponding to S54.

The operation of the method of and the apparatus for controlling stacking by the crane is explained with reference to FIG. 2 and FIG. 3. The method of and the apparatus for controlling stacking by the crane of the present invention comprise the following four kinds of calculation and control elements, 1) estimation and calculation of horizontal direction position of the hung container by means of current measure data and dynamic model of crane behavior,
2) trolley position control which bring horizontal direction position deviation of the hung container and the subject container in the stacking target amplitude into a permissible value,
3) estimation and calculation of landing time from height position of the current hung container and speed of descending, and
4) control of descending timing and speed of the hung container which allow the hung container to land on the subject container when hung container reaches the stacking target amplitude from the instant when the hung container horizontal position is estimated.

The estimation of the hung container horizontal position in the element 1) and estimation of landing time in the element 3) are always carried out using measurement data.

The control of each of the elements 2) and 4) is carried out at appropriate time while the hung container is being lowered toward the subject container. The control of 4) is carried out after the control of 2).

Figure 2:
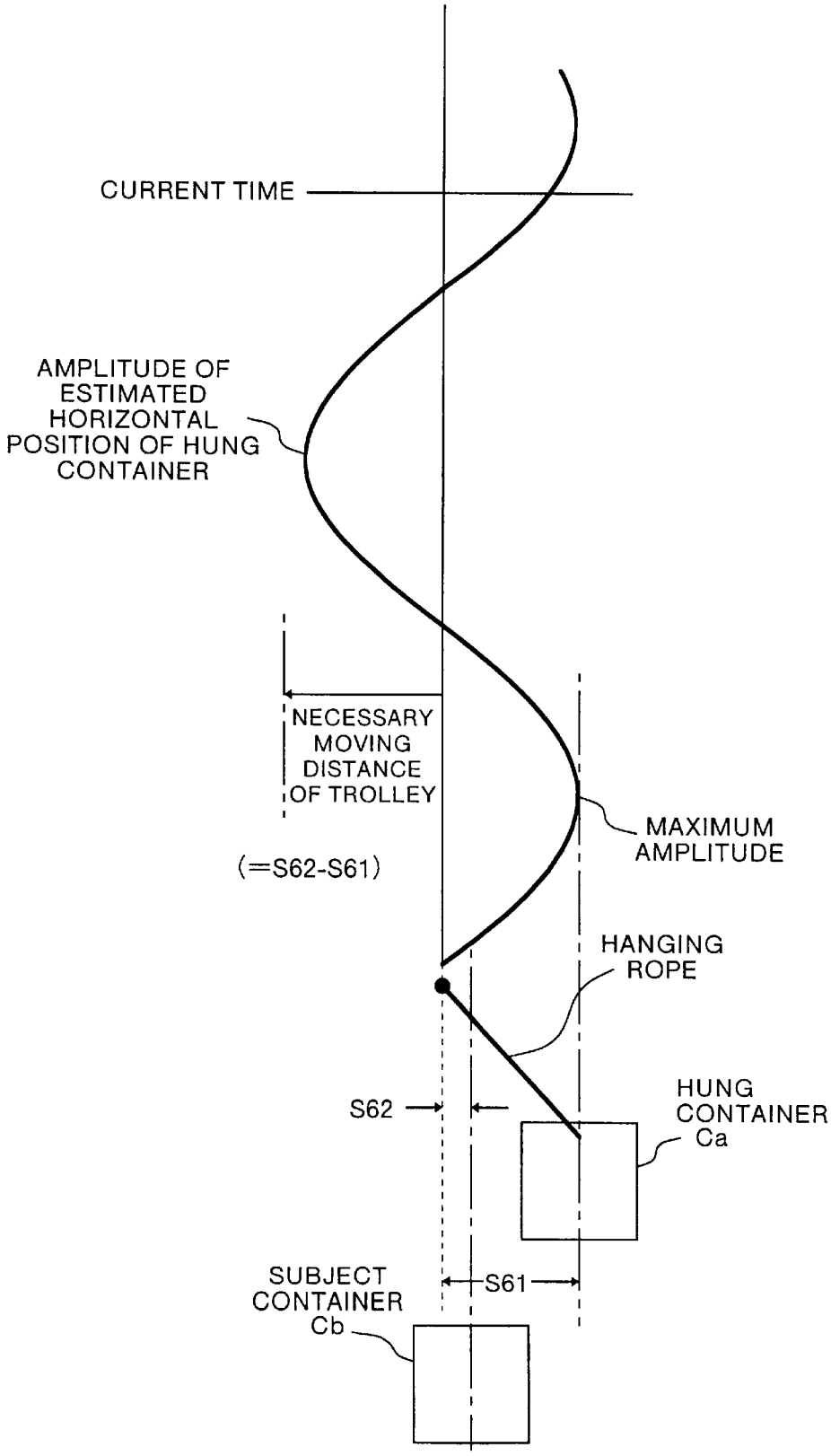
FIG. 2 is an explanatory view of calculation of load position target concerning the stacking control apparatus of the invention.

FIG. 2 explains the operation of the element 2). FIG. 2 shows the operation of positional control of the trolley based on a case in which the stacking target amplitude is maximum. In FIG. 2, a reference symbol S61 is a maximum value of amplitude of the periodical displacement of the horizontal direction position of the hung container, and this is obtained by estimation and calculation of the horizontal direction position of the hung container. A reference symbol S62 is a horizontal position deviation between the hung container and the subject container which is not vibrational. Thus, a necessary moving amount of the trolley is a difference between S61 and S62.

If the trolley is moved by the above-described moving amount, a new swing (horizontal position displacement) is generated in the hung container and with this, a new positional deviation is caused. In the trolley position control element, the dynamic behavior model and a trolley movement control model of the crane are incorporated. The estimation of the hung container horizontal position caused by movement of the trolley is simulated by these models, and the speed setting of the trolley driving control is corrected such that the trolley is moved to an appropriate position with respect to estimation of new swing of the hung container.

Figure 3:
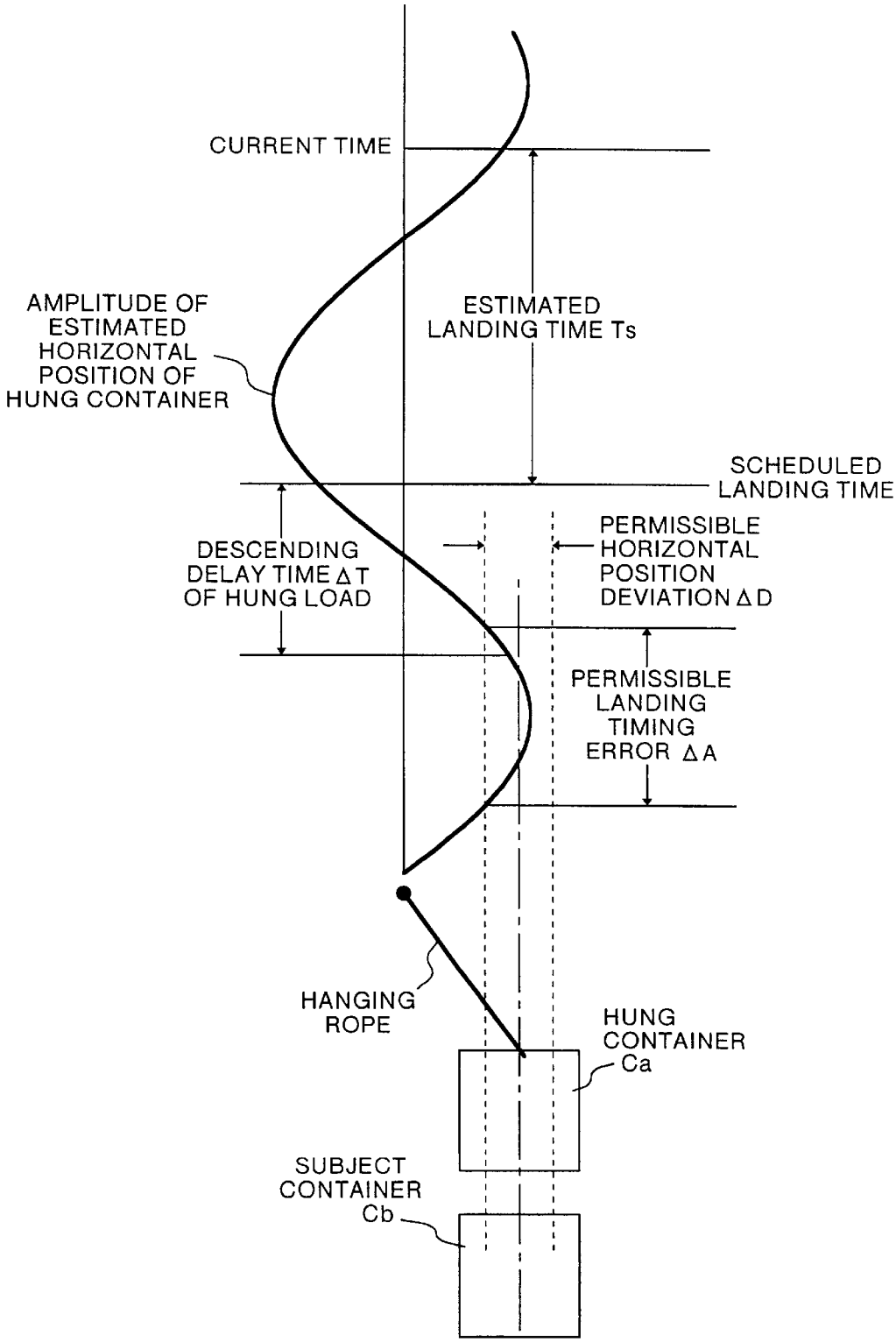
FIG. 3 is an explanatory view of load descending speed and descending timing control concerning the stacking control apparatus of the invention.

FIG. 3 explains the operation of control in which the descending timing and the speed of descending of the hung container are controlled, and the hung container is allowed to land with respect to the subject container with permissible horizontal position deviation $\Delta D$. FIG. 3 shows a case in which coincidence of horizontal position is detected at the instant when the hung container lands on the subject container with maximum amplitude.

A reference symbol Ts in FIG. 3 shows time required for the hung container to land on the subject container which is estimated from the height position measurement value of the hung container and speed of descending measurement value at the current time. The variation in horizontal position of the hung container does not become maximum amplitude by estimation and calculation data of the horizontal position of the hung container after the time Ts. Therefore, the speed of descending is set such that the hung container lands during the permissible landing timing error ΔA by setting the time ΔT which delays time until the hung container lands, and by delaying the landing time by this ΔT, and a value which is to be output to the reeling apparatus is calculated.

The permissible landing timing error ΔA is determined by the permissible horizontal direction deviation ΔD and variation state of vibrational horizontal direction position of the hung container when the hung container is stacked on the subject container.

The estimation and calculation of the horizontal position of the hung container, calculation of reaching time to the maximum amplitude, and calculation of required time for landing are carried out from moment to moment by measurement values of the hung container position, moving speed of the hung container, horizontal direction of the hung container and speed of descending as well as dynamic behavior model. Depending upon the result, the descending timing of the hung container and its speed are varied, thereby realizing control which stack the hung container on the subject container within the permissible horizontal position deviation.

According to this control, it is possible to stack hung container with high precision while taking into account the deformation of the crane bodywork and influence of the swing-preventing auxiliary rope and the like, and by positioning the hung container and the subject container by control of the trolley position, it is possible to shorten time required for stacking without being affected by swinging period of the rope.

In the stacking control of the container crane, if the coincidence of the horizontal position at time when the hung container is landed on the subject container with respect to the maximum amplitude of the horizontal position displacement of the hung container is detected, it is possible to further enhance the precision of the horizontal position of the upper and lower containers at the time of landing.

That is, since the horizontal motion of the hung container is close to the sine wave, the speed in the horizontal direction is 0 or close to 0 in the vicinity of maximum amplitude phase. For this reason, influence of error generated between timing of instant when the amplitude reaches its maximum and timing of landing of the hung container caused by errors such as error of estimation and calculation of horizontal direction position of the hung container, error of estimation and calculation of unreeling time until landing, and error of unreeling control becomes maximum when coincidence of horizontal positions of both the containers is detected at maximum amplitude. That is, if the coincidence of horizontal positions of both the containers is detected at the maximum value of the amplitude of the horizontal position displacement of the hung container, the horizontal direction position deviation between the hung container and the subject container can be reduced as compared with another amplitude.

It is possible to carry out at least one of or a combination of estimation and calculation of horizontal position of the hung container, calculation of time during which the amplitude of horizontal position displacement of the hung container becomes maximum, control of the speed of descending in which time required for landing becomes equal to descending timing of the tool, and control which move the trolley position and bring the horizontal positions of the hung container and the subject container into agreement at the maximum amplitude.

The case in which the trolley moves horizontally on the camber of the crane has been explained above, but it is of course possible to employ a crane in which the rope support point of the load is fixed on the crane bodywork and the crane bodywork moves. In this case, if the crane bodywork moves instead of the moving trolley, the same effect as that when the trolley moves can be obtained.

The present invention has been explained while taking the case of application to the container loading crane, but the invention can also be applied to a case in which in a crane which loads a load, a position where the load is stacked is given, and a positional relation between the load and an already stacked load can be measured.

Embodiment

Figure 4:
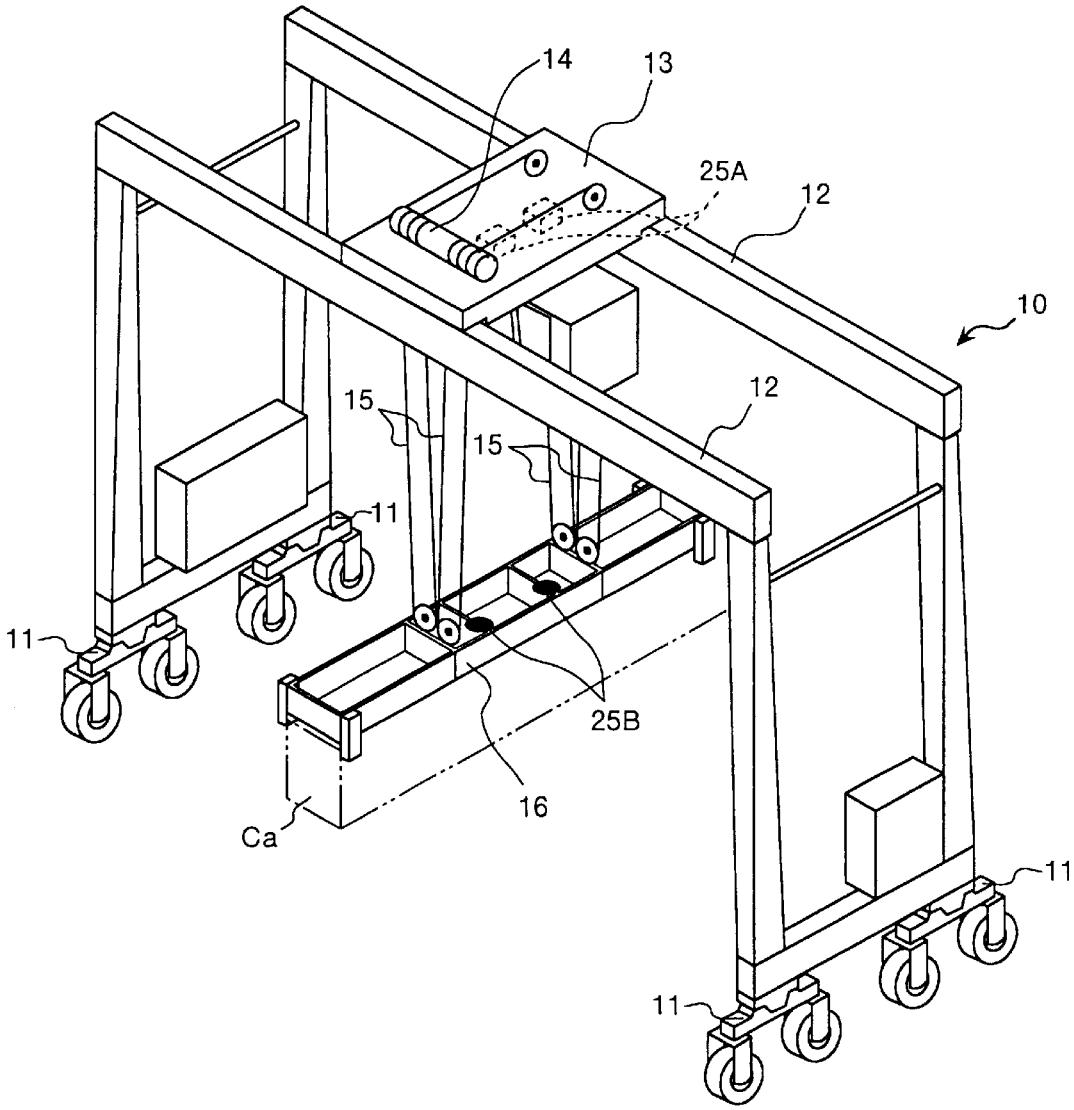
FIG. 4 is a perspective view which shows the entire structure of a container crane to which the stacking control apparatus of the invention is applied.

An embodiment in which the method of and the apparatus for controlling stacking by the crane of the present invention is applied to a transfer crane is explained next. FIG. 4 shows the entire structure of the transfer crane of the embodiment. This transfer crane is a tire type bridge-like crane which stacks containers, and has a gantry crane running bodywork 10 which runs on railless surface by a tire type running apparatus 11. The crane running bodywork 10 has a horizontal upper camber 12, and the upper camber 12 is provided with a transverse trolley 13 which moves in the horizontal direction along the upper camber 12.

A reeling apparatus 14 is mounted on the transverse trolley 13, and a tool (spreader) 16 for container is hung down using a rope 15 which reels or unreels by the reeling apparatus 14. The tool 16 can hold a container Ca which is a load such that the container Ca can be engaged or disengaged.

Figure 5:
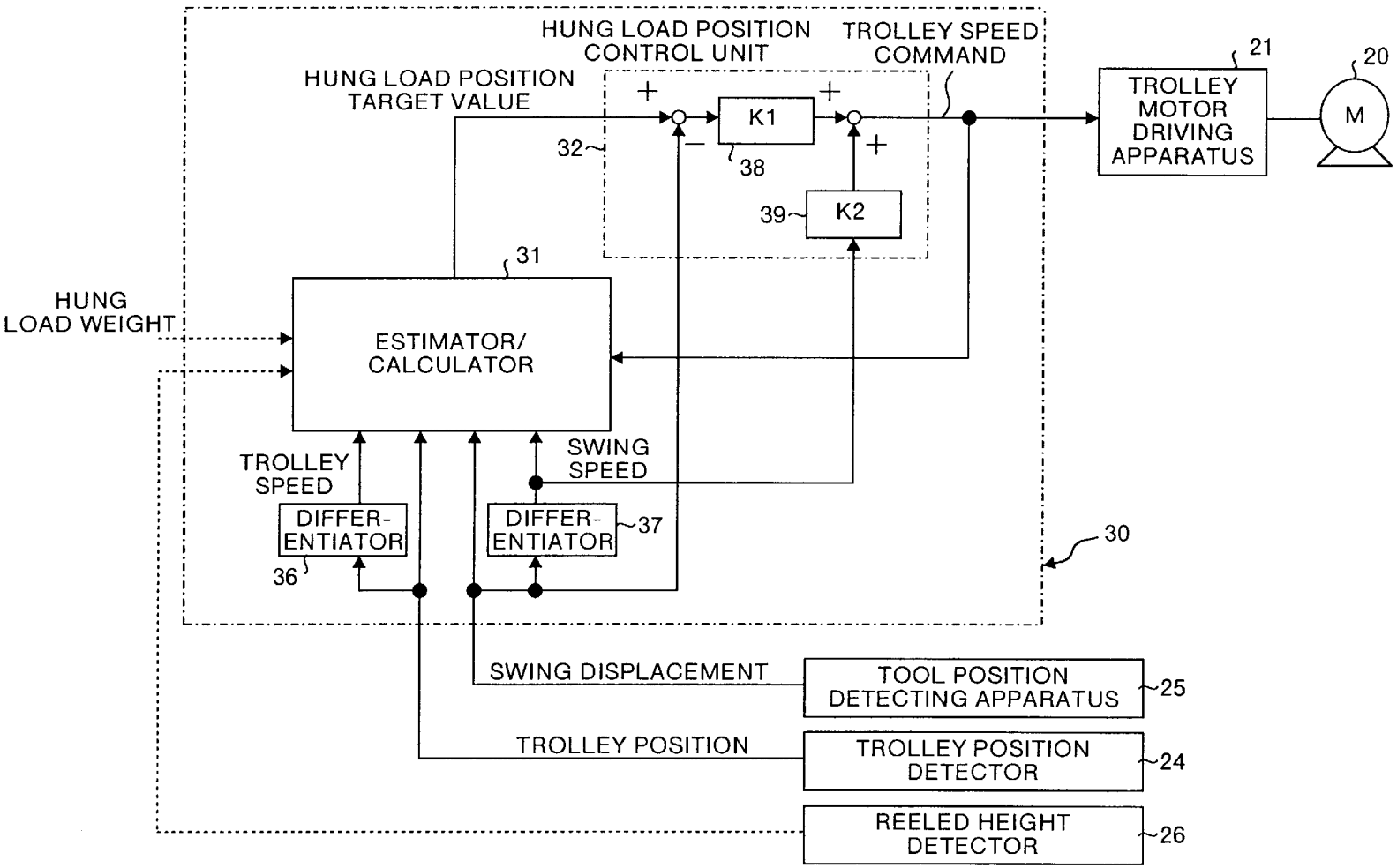
FIG. 5 is a block diagram of a tool position control system of the stacking control apparatus of the invention.
Figure 6:
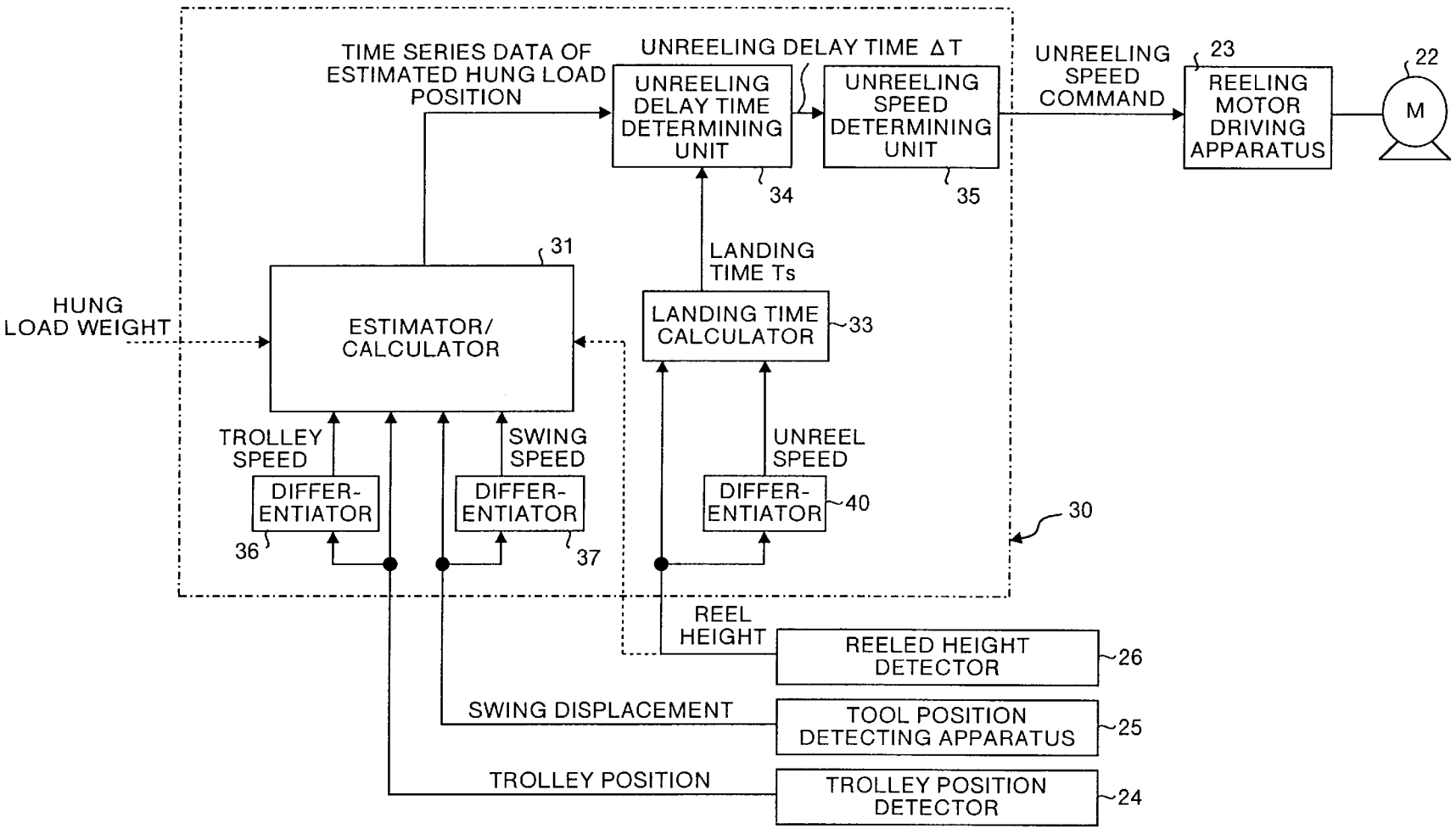
FIG. 6 is a block diagram of a load unreeling speed control system of the stacking control apparatus of the invention.

FIG. 5 and FIG. 6 show an embodiment of a driving control system of the transfer crane and the position control apparatus of the crane of the invention. The transfer crane includes a trolley position detector 24 comprising a trolley track transverse motor 20 which transversely drives the transverse trolley 13, an rotor encoder connected to the motor and the like, and a reeled height detector 26 comprising a reeling motor 22, an rotor encoder connected to the motor and the like.

The transfer crane is provided with a tool position detecting apparatus 25 which detects horizontal relative position (lateral swing) between the transverse trolley 13 and the tool 16. The tool position detecting apparatus 25 includes a CCD camera 25A (see FIG. 4) which shoots a tool target marker 25B which is a shooting target fixed in the container tool 16 and disposed on the transverse trolley 13. The tool position detecting apparatus 25 detects the horizontal relative position (lateral swing) of the tool 16 with respect to the transverse trolley 13 by the shoot data (tool target marker detection image signal) of the CCD camera 25A.

The trolley track transverse motor 20 and the reeling motor 22 are driven by electric control of a trolley motor driving apparatus 21 and a reeling motor driving apparatus 23. A trolley speed command signal and a unreeling speed command signal are sent from a crane control apparatus 30 to these driving apparatuses 21 and 23, respectively.

The crane control apparatus 30 comprises an estimator/calculator 31 which estimates and calculates the lateral swing of the tool 16, a load position control unit 32, a landing time calculator 33, an unreeling delay time determining unit 34 and an unreeling speed determining unit 35.

The estimator/calculator 31 inputs the trolley position detected by the trolley position detector 24, trolley speed obtained by differentiating the signal of the trolley position by a differentiator 36, swing displacement of the tool 16 (or of the hung container) detected by the tool position detecting apparatus 25, swinging speed obtained by differentiating the signal of the swing displacement by a differentiator 37, and trolley speed command output by the load position control unit 32. Using the input values as variables, the estimator/calculator 31 estimates and calculates a horizontal position variation (lateral swing) of the tool 16 in a state in which the container Ca is hung down by the tool 16.

Figure 7:
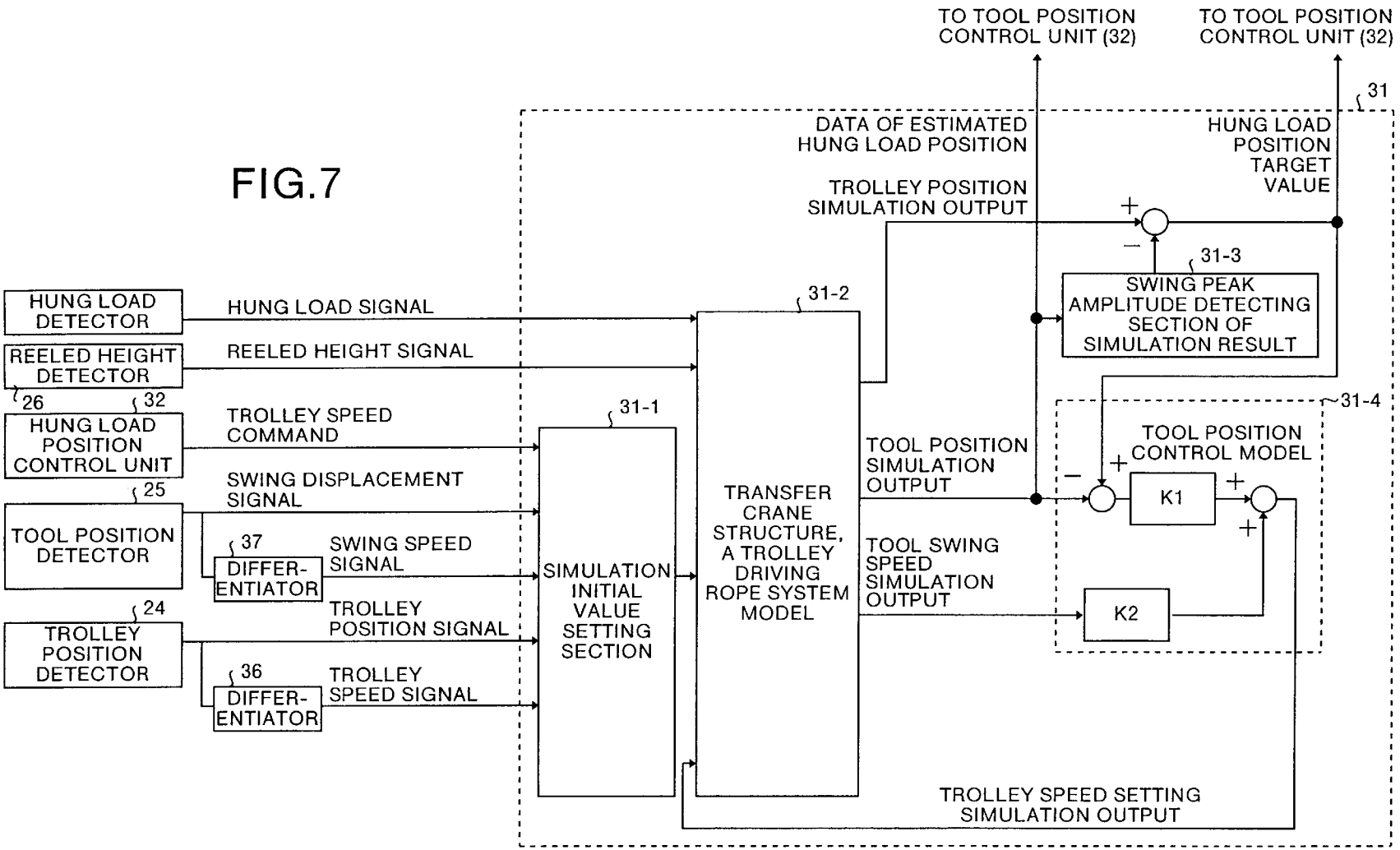
FIG. 7 is an explanatory view which shows a structure of an estimating calculator in the stacking control apparatus of the invention.

An example of structure of the estimator/calculator 31 is explained concretely with reference to FIG. 7.

In FIG. 7, a portion surrounding by a broken line 31 shows an inner structure of the estimator/calculator 31 shown in FIG. 5 and FIG. 6. Input and output signals of the estimator/calculator 31 shown in FIG. 7 corresponds to a calculator 31 shown in FIG. 5 and FIG. 6.

As shown in FIG. 7, the estimator/calculator 31 comprises a simulation initial value setting section 31-1, a transfer crane structure, a trolley driving rope system model 31-2 (crane behavior model, hereinafter), a swing peak amplitude detecting section 31-3 (swing peak detecting section, hereinafter) of simulation result, and a tool position control model 31-4.

The crane behavior model 31-2 is formed by modeling behaviors such as a structure of the crane, a machine apparatus, the rope and the like to calculate a displacement of the load in the horizontal direction and the like by simulation using, as an initial value, a measurement value such as trolley position input from various detectors, trolley speed, horizontal displacement of the tool (swing)) displacement speed of the tool (swing speed) and the like.

The tool position control model 31-4 is a model which simulates a behavior of the load position control unit 32 included in the crane control apparatus 30. Gain constants K1 and K2 included in the model 31-4 are equal to K1 (38) and K2 (39) shown in FIG. 5.

When the trolley speed is controlled using detection signals such as the trolley position as the initial value by combining the crane behavior model 31-2 and the tool position control model 31-4, the periodical displacement of the load (container), speed of periodical displacement and the trolley position are estimated and simulated. A result of the estimation and simulation is a time series data of estimated load (container) position in a period during which at least the estimated load (container) position reaches the maximum amplitude. Other simulation results are variation in trolley position in the period.

The swing peak detecting section 31-3 detects the maximum amplitude from the time series data of the estimated load (container) position which is a result of the simulation, and outputs the same. A difference between this output and the trolley position which is the simulation result is set to a target value of the load (container) position with respect to the load position control unit 32 included in the crane control apparatus 30. That is, a value obtained by deviating the trolley position estimated value by the simulation result by an amount corresponding to the maximum amplitude value obtained by the simulation is set as a set value of the load position control unit 32.

This operation corresponds to calculation of necessary moving amount of trolley (S62 to S61), and the load position control unit 32 controls to move the position of the rope support point on the trolley to a position deviated by an amount corresponding to the maximum amplitude.

The load position control unit 32 inputs a target value of the load position, swing displacement and swing speed of the tool 16 (load) detected by the tool position detecting apparatus 25, carries out positioning control calculation of the load such that moving completion stop position of the transverse trolley (load) 13 coincides with the target value of the load position based on the positioning control gain K1 by a positioning control gain setting device 38, carries out swing-preventing control calculation such that the swing speed becomes small based on the swing-preventing control gain K2 by a swing-preventing control setting device 39, and outputs a trolley speed command to the trolley motor driving apparatus 21.

The landing time calculator 33 calculates time (landing time) Ts from the completion of the load position control to the landing, from a reeled height detected by the reeled height detector 26 and unreeling speed obtained by differentiation using a differentiator 40.

The unreeling delay time determining unit 34 inputs time series data of the estimated tool position from the estimator/calculator 31, and inputs the landing time Ts by the landing time calculator 33, and as shown in FIG. 3, the unreeling delay time determining unit 34 determines the descending delay time ΔT of the load such that the hung container Ca lands on the subject container Cb when the horizontal direction position displacement (lateral swing) becomes maximum amplitude.

The unreeling speed determining unit 35 determines the speed of descending (deceleration characteristics) based on the descending delay time ΔT of the load, and outputs the unreeling speed command to the reeling motor driving apparatus 23. The deceleration characteristics is set by a deceleration coefficient which has correlation to the descending delay time ΔT. In the unreeling speed control step, the speed is reduced to a specified speed of descending (extremely low speed close to 0) at the time of landing.

Next, a stacking operation in a plurality of stacks manner of the containers carried out by the crane control apparatus 30 having the above-described structure is explained. First, horizontal direction position displacement (lateral swing) of he tool 16 in a state in which the hung container Ca is hung down by the tool 16 is estimated and calculated using the estimator/calculator 31. Then, as the load position control step, a position which is deviated by horizontal direction position displacement (lateral swing) S51 of the tool 16 at the time of estimated landing with respect to the target container Cb is set to a target value of the load position (trolley stop position), and the transverse trolley 13 is positioned and stopped by the load position control unit 32. In this load position control section, swing-preventing control is also carried out together with positioning control.

If the load position control was completed and the transverse trolley 13 was stopped, the unreeling speed control step is started. In the unreeling speed control step, deceleration control of the speed of descending of the tool 16 is carried out. After the landing time Ts calculated by the landing time calculator 33 and the unreeling delay time ΔT determined by the unreeling delay time determining unit 34 have been elapsed from the completion time (current time in FIG. 3) of the load position control, the hung container Ca lands on the target container Cb at the specified landing speed of descending.

This landing timing is a time point at which the horizontal direction position displacement (lateral swing) of the tool 16at the time of landing becomes maximum amplitude at the descending delay time ΔT of load, and the hung container Ca of the tool 16 lands on the target container. At the time of landing, if the coincidence of the horizontal position of the upper and lower containers is detected at the maximum amplitude, since speed of the lateral swing is zero when the lateral swing of the tool 16 becomes maximum, the hung container Ca lands at lateral swing speed 0. With this structure, it is unnecessary to wait until the lateral swing at the time of landing is eliminated, and it is possible to effectively carry out appropriate landing while keeping horizontal deviation of the upper and lower containers within the permissible value without requiring labor of the crane operator.

It has been explained in this embodiment that the lateral swing of the tool 16 is estimated and calculated using the trolley position, the trolley speed, the swing displacement, the swing speed, and the trolley speed command. However, estimation and calculation of the lateral swing of the tool 16 can be performed more precisely using additional information concerning the reel height and information concerning load weight.

As explained above, according to the method of and the apparatus for controlling stacking by the crane of the invention, the lateral swing of the tool is estimated in a state in which the container is hung down from the tool, and the landing is carried out at the lateral swing maximum time point of the tool where the swing speed of the tool becomes zero. Therefore, it is unnecessary to wait until the lateral swing is eliminated, and it is possible to carry out appropriate landing. Further, by positioning and stopping the trolley while determining the position deviated from the target container by an amount of lateral swing of the tool as the trolley stop position, it is possible to effectively carry out appropriate landing while keeping horizontal deviation of the upper and lower containers within the permissible value without requiring labor of the crane operator, and a stacking operation of the containers in a plurality of stacks manner can be carried out automatically.

In other words, it is possible to realize landing and stacking control in which even when a trolley position of the rope is varied by deformation of movement of the bodywork like a crane having bodywork of low rigidity structure or a tire running crane, and even when the rope system can not be regarded as a simple pendulum, landing can be carried out with high precision, and time required for landing can be shortened. Therefore, it is possible to provide a landing and method of and the apparatus for controlling stacking by the crane capable of realizing automatic crane of high efficiency, and enhancing loading efficient.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A method of controlling stacking of a load by a crane, said crane having a trolley which moves in a horizontal direction, and a tool which is hung down using a rope from said trolley and which ascends and descends by a reeling or an unreeling operation and which holds a load to be stacked on a stacking target position, the method comprising:

estimating periodical displacement of said tool in a horizontal position, controlling a speed with which said tool descends in such a manner that said tool or the load held by said tool lands on the stacking target position when an amplitude of the estimated periodical displacement becomes maximum, and landing said tool or said load.

2. The method according to claim 1, further comprising:

detecting or calculating any one or more parameters of a trolley moving position, a trolley moving speed, a tool horizontal position displacement amount, a tool horizontal position displacement speed, a trolley speed command, a tool reeled height, a load weight, based on one or a combination of the parameters, building a simulation model comprising at least one of or a combination of the parameters related to the horizontal position displacement of one or more of a mechanism of said crane, driving and control mechanism of said trolley, said rope, and estimating or calculating the horizontal position displacement of said tool based on the built simulation model.

3. A method of controlling stacking of a load by a crane, said crane having a trolley which moves in a horizontal direction, and a tool which is hung down using a rope from said trolley and which ascends and descends by a reeling or an unreeling operation and which holds a load to be stacked on a stacking target position, the method comprising:

estimating periodical displacement of said tool in a horizontal position, positioning and stopping said trolley at a trolley stop position which is deviated from a stacking target position by a distance corresponding to a maximum amplitude of the periodical displacement, and controlling a speed with which said tool descends in such a manner said tool or a load held by said tool lands on the stacking target position when an amplitude of the estimated periodical displacement becomes maximum, and landing said tooll said load.

4. The method according to claim 3, further comprising:

detecting or calculating any one or more parameters of a trolley moving position, a trolley moving speed, a tool horizontal position displacement amount, a tool horizontal position displacement speed, a trolley speed command, a tool reeled height, and a load weight, based on one or a combination of the parameters, building a simulation model comprising at least one of or a combination of the parameters related to the horizontal position displacement of one or more of a mechanism of said crane, driving and control mechanism of said trolley, and said rope, and estimating or calculating the horizontal position displacement of said tool based on the built simulation model.

5. An apparatus for controlling stacking of a load by a crane, said crane having a trolley which moves in a horizontal direction, and a tool which is hung down using a rope from said trolley and which ascends and descends by a reeling or an unreeling operation and which holds a load to be stacked on a stacking target position, said apparatus comprising:

a load position control unit which estimates periodical displacement of said tool in a horizontal position and which positions and stops said trolley at a trolley stop position which is deviated from a stacking target position by a distance corresponding to a maximum amplitude of the periodical displacement, and a descending load speed control unit which controls a speed with which said tool descends in such a manner said tool or a load held by said tool lands on the stacking target position when an amplitude of the estimated periodical displacement becomes maximum, and lands said tool or said load.

6. The apparatus according to claim 5, comprising an estimating/calculating unit which detects or calculates any one or more parameters of a trolley moving position, a trolley moving speed, a tool horizontal position displacement amount, a tool horizontal position displacement speed, a trolley speed command, a tool reeled height, and a load weight, based on one or a combination of the parameters, builds a simulation model comprising at least one of or a combination of the parameters related to the horizontal position displacement of one or more of a mechanism of said crane, driving and control mechanism of said trolley, and said rope, and estimates or calculates the horizontal position displacement of said tool based on the built simulation model.

7. A method of controlling stacking of a load by a crane, said crane having a trolley which moves in a horizontal direction, a tool which is hung down using a rope from said trolley and which holds said load, and a rope reeling unit which reels or unreels said rope and thereby ascends or descends said load and stacks said load or said tool to a desired position, the method comprising:

estimating periodical displacement of said tool in a horizontal position, estimating a speed with which said tool descends in such a manner that said tool or said load lands on the desired position while an amplitude of the estimated periodical displacement becomes maximum, and controlling reeling or unreeling of said rope by said rope reeling unit in such a manner that said tool or said load descends at the estimated speed.

8. A method of controlling stacking of a load by a crane, said crane having a trolley which moves in a horizontal direction, a tool which is hung down using a rope from said trolley and which holds said load, and a rope reeling unit which reels or unreels said rope and thereby ascends or descends said load and stacks said load or said tool to a desired position, the method comprising:

estimating periodical displacement of said tool in a horizontal position, positioning and stopping said trolley at a trolley stop position which is deviated from a stacking target position by a distance corresponding to a maximum amplitude of the periodical displacement, estimating a speed with which said tool descends in such a manner that said tool or said load lands on the desired position while an amplitude of the estimated periodical displacement becomes maximum, and controlling reeling or unreeling of said rope by said rope reeling unit in such a manner that said tool or said load descends at the estimated speed.

9. An apparatus for controlling stacking of a load by a crane, said crane having a trolley which moves in a horizontal direction, a tool which is hung down using a rope from said trolley and which holds said load, and a rope reeling unit which reels or unreels said rope and thereby ascends or descends said load and stacks said load or said tool to a desired position, said apparatus comprising:

an estimating/calculating unit which estimates or calculates periodical displacement of said tool in a horizontal position, a speed estimating unit which estimates a speed with which said tool descends in such a manner that said tool or said load lands on the desired position while an amplitude of the estimated periodical displacement becomes maximum, and a rope reeling control unit which controls reeling or unreeling of said rope by said rope reeling unit in such a manner that said tool or said load descends at the speed estimated by said speed estimating unit.

10. An apparatus for controlling stacking of a load by a crane, said crane having a trolley which moves in a horizontal direction, a tool which is hung down using a rope from said trolley and which holds said load, and a rope reeling unit which reels or unreels said rope and thereby ascends or descends said load and stacks said load or said tool to a desired position, said apparatus comprising:

an estimating/calculating unit which estimates or calculates periodical displacement of said tool in a horizontal position, a trolley stopping unit which positions and stops said trolley at a trolley stop position which is deviated from a stacking target position by a distance corresponding to a maximum amplitude of the periodical displacement, a speed estimating unit which estimates a speed with which said tool descends in such a manner that said tool or said load lands on the desired position while an amplitude of the estimated periodical displacement becomes maximum, and a rope reeling control unit which controls reeling or unreeling of said rope by said rope reeling unit in such a manner that said tool or said load descends at the speed estimated by said speed estimating unit.

* * * * *